US005232611A

United States Patent [19]

Ohashi et al.

[11] Patent Number: 5,232,611

[45] Date of Patent: Aug. 3, 1993

[54] FIBER TREATMENT AGENT

[75] Inventors: Hiroshi Ohashi; Masaki Tanaka, both of Gunma, Japan

[73] Assignee: Shin-Etsu Chemical Co., Ltd., Tokyo, Japan

[21] Appl. No.: 608,761

[22] Filed: Nov. 5, 1990

[30] Foreign Application Priority Data

Nov. 6, 1989 [JP] Japan ..... 1-289375

[51] Int. Cl.[5] ..... D06M 10/08; C11D 17/00; B05D 3/02

[52] U.S. Cl. ..... 252/8.6; 252/8.7; 252/8.8; 252/8.9; 252/174.15; 427/387; 427/392

[58] Field of Search ..... 252/8.6, 8.7, 8.75, 252/8.8 R, 8.9, 174.15; 427/387, 392

[56] References Cited

U.S. PATENT DOCUMENTS 4,293,611 10/1981 Martin ..... 252/8.9
4,351,736 9/1982 Steinberger et al. ..... 427/387
4,352,917 10/1982 Tripp ..... 427/387
4,394,517 7/1983 Martin et al. ..... 252/8.8
4,399,247 8/1983 Ona et al. ..... 252/8.8
4,401,698 8/1983 Tripp ..... 427/392
4,958,039 9/1990 Pechhold ..... 252/8.8

*Primary Examiner*—Paul Lieberman
*Assistant Examiner*—William S. Parks
*Attorney, Agent, or Firm*—Millen, White, Zelano, & Branigan

[57] ABSTRACT

This invention discloses a fiber treatment agent characterized in that it comprises:

(A) 100 parts by weight of an organopolysiloxane with no less than 2 hydroxyl groups and/or alkoxyl groups bonded to Si atoms per molecule, (B) 0.5–50 parts by weight of silica and/or a polysilsesquioxane, (C) 0.1–20 parts by weight of an organoalkoxysilane containing amide groups and carboxyl groups, and/or its partial hydrolysis condensate, (D) 0.1–20 parts by weight of an organoalkoxysilane containing amino groups or epoxy groups and/or its partial hydrolysis condensate, and (E) 0.01–10 parts by weight of a curing catalyst, and characterized in that it is also a cationic or non-ionic emulsion.

18 Claims, No Drawings

FIBER TREATMENT AGENT

FIELD OF THE INVENTION

This invention concerns a fiber treatment agent, and in particular, a silicone agent which satisfactorily prevents shrinking of fibers and softens them.

BACKGROUND OF THE INVENTION

Fibers (keratinous fibers) such as wool possess a scaly surface structure. Owing to this structure, the fibers tend to tangle and mat together when they are washed, and they shrink. Conventionally, the following methods which make use of silicone treatment agents have been proposed to overcome this disadvantage.

Japanese patent Kokoku (Japanese Examined Published Patent) 48-33435 proposes a method employing a composition comprising an organic solvent solution of a straight chain polysiloxane with terminal hydroxyl groups and a viscosity of no less than 50 cSt, and a catalyst.

Japanese Patent Kokoku 48-38036 proposes a method employing a chlorinated solvent solution of a high molecular weight polysiloxane and a catalyst.

Japanese Patent Kokoku 53-28468 proposes a method employing a composition of a diorganopolysiloxane with amino groups and alkoxyl groups.

Japanese Patent Kokoku 58-4114 proposes a method employing a composition of an organopolysiloxane with mercapto groups and amino groups.

The effect of these anti-shrink agents was however invariably inadequate when the fibers were washed, and in particular, anti-shrink properties were not retained if they were washed repeatedly. Further, the feel of treated fiber products tended to be lost, and no anti-shrink softener which could withstand washing had therefore been perfected.

The inventors discovered an anti-shrink softener which was durable with regard to washing, and arrived at the present invention.

SUMMARY OF THE INVENTION

An object of this invention is therefore to provide a fiber treatment agent which stands up to washing satisfactorily, prevents fibers from shrinking and softens fibers. Above object has been attained by a fiber treatment agent which is characterized in that it comprises;

(A) 100 parts by weight of an organopolysiloxane with no less than 2 hydroxyl groups and/or alkoxyl groups bonded to Si atoms in per molecule, (B) 0.5–50 parts by weight of silica and/or a polysilsesquioxane, (C) 0.1–20 parts by weight of an organoalkoxysilane containing amide groups and carboxyl groups, and/or its partial hydrolysis condensate, (D) 0.1–20 parts by weight of an organoalkoxysilane containing amino groups or epoxy groups and/or its partial hydrolysis condensate, and (E) 0.01–10 parts by weight of a curing catalyst, and characterized in that it is also a cationic or non-ionic emulsion.

DETAILED DESCRIPTION OF THE INVENTION

There is no particular restriction on the organopolysiloxane component (A), except that it must contain no less than 2 hydroxyl and/or alkoxyl groups bonded to Si atoms per molecule. The sites at which these hydroxyl groups and/or alkoxyl groups are bonded, the types of organic groups apart from hydroxyl and alkoxyl which are bonded to Si atoms, molecular structure and degree of polymerization, etc., are unrestricted. From the viewpoint of softness of the fiber, however, it is desirable that there is no less than 1 aminoalkyl group present as an organic group apart from hydroxyl and alkoxyl per molecule.

This organopolysiloxane may be synthesized by any of the known methods. Organopolysiloxanes containing hydroxyl groups and alkoxyl groups may for example respectively be obtained by equilibration reaction of cyclic siloxanes such as octamethyl cyclotetrasiloxane with $\alpha$, $\omega$-hydroxypolysiloxane oligomers or organoalkoxysilanes. Further, organopolysiloxanes containing aminoalkyl groups may be obtained by equilibration reaction of aminoalkoxysiloxanes or their hydrolysis condensation products with cyclic siloxanes as above.

Further, an emulsion of said organopolysiloxanes may be obtained by emulsion polymerization as in the prior art. Such an emulsion is easily synthesized by emulsified dispersion in water, cyclic siloxanes, organoalkoxysilanes and aminoalkoxysilanes and/or its hydrolysis condensation products using cationic surfactants, addition of alkali metal hydroxide catalysts to the resulting emulsified dispersions, and carrying out a polymerization reaction. The organoalkoxysilanes specified here may be represented by the general formula:

$$R^1_xSi(OR^2)_{4-x}$$

where $R^1$ is a monovalent hydrocarbon group with 1–20 carbon atoms, $R^2$ is a monovalent hydrocarbon group with 1–6 carbon atoms, and x is 0, 1 or 2. Specific examples are dimethyl dimethoxysilane, methyl triethoxysilane, ethyltrimethoxysilane, methyl phenyl dimethoxysilane, methyltributoxysilane and tetraethoxysilane.

Two or more of the above organoalkoxysilanes may also be used in admixture.

Further, the aminoalkoxysilanes specified here may be represented by the general formula:

$$AR^1_ySi(OR^2)_{3-y}$$

where $R^1$ and $R^2$ are the same as in the case of the organoalkoxysilanes above. In this formula, A is an aminoalkyl group represented by $-R^3(NR^4R^5)_nNR^6R^7$ where $R^3$ and $R^5$ are bivalent hydrocarbon groups with 1–6 carbon atoms, $R^4$, $R^6$ and $R^7$ are hydrogen atoms or monovalent hydrocarbon groups with 1–20 carbon atoms, and n is an integer from 0–4. y is 0, 1 or 2. Typical examples are given by the following formulae:

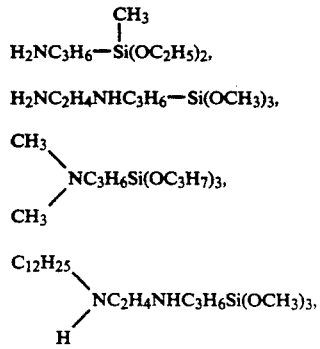

-continued

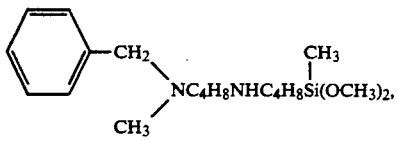

$H_2NC_2H_4NHC_2H_4NHC_3H_6Si(OC_2H_5)_3$.

It is preferable that the organopolysiloxanes synthesized by the above equilibration method are prepared in the form of an emulsified dispersion in water using a cationic or non-ionic surfactant. Cationic emulsions are adsorbed well by fibers, while non-ionic emulsions can be used together with other reagents such as anionic treatment agents.

Component (B), silica and/or a polysilsesquioxane, is used to improve the strength of the silicone rubber coating. It is preferable to have component (B) in an emulsion form, either by preparing an emulsified dispersion of it in water using cationic or non-ionic surfactants, or after preparing such a dispersion of the organoalkoxysilane represented by the general formula $R^8_zSi(OR^2)_{4-z}$ ($R^8$ being a monovalent hydrocarbon group with 1-20 carbon atoms or an organic group wherein the hydrogen atoms bonded to these carbon atoms are partially substituted by epoxy, amino, carboxyl, hydroxyl, cyano and (meth)acryl groups, $R^2$ being the same as in the case of the above organoalkoxysilanes and z being 0 or 1) using cationic or non-ionic surfactants, adding an alkali metal hydroxide or other catalyst and performing a hydrolysis condensation reaction.

The blending proportion of component (B) is 0.5-50 parts by weight with respect to 100 parts by weight of component (A), and preferably 1-30 parts by weight. If the proportion is less than 0.5 parts by weight, it does not improve the strength of the silicone rubber coating, while if it is greater than 50 parts by weight, the coating becomes hard, brittle and its strength declines.

Component (C), an organoalkoxysilane containing amide groups and carboxyl groups and/or its partial hydrolysis condensate, improves the adhesion of the silicone rubber coating to the fibers. It may be obtained by reacting an aminoalkoxysilane and/or its partial hydrolysis condensate with an acid anhydride.

The aminoalkoxysilane starting material required to obtain component (C) is represented by the afore mentioned general formula $AR^1_ySi(OR^2)_{3-y}$, and its partial hydrolysis condensate may also be used instead.

The acid anhydride used to react with said aminoalkoxysilane may for example be phthalic anhydride, succinic anhydride, methyl succinic anhydride, maleic anhydride, pyromellitic anhydride, trimellitic anhydride, itaconic anhydride, glutanic anhydride, diphenic anhydride and benzophenone tetracarbonic anhydride, but the invention is not limited to these anhydrides.

Component (C) of this invention may easily be obtained by mixing said starting materials in a solvent which has affinity toward them, for example alcohol, at room temperature for 1-5 hours. In this case, the reacting substances must contain at least 1 amide group and carboxyl group per molecule, so 1 mole of acid anhydride must be reacted for each NH group present in 1 molecule of aminoalkoxysilane or its partial hydrolysis condensate.

The blending proportion of component (C) is 0.1-20 parts by weight with respect to 100 parts by weight of component (A), and preferably 0.5-10 parts by weight. If it is less than 0.1 parts by weight, there is no improvement of adhesion to the fiber, and if it is greater than 20 parts by weight, the softness of the treated fabric declines.

Component (D) of this invention which is an organoalkoxysilane with amino groups or epoxy groups or its partial hydrolysis condensate functions as a crosslinking agent for component (A), the organopolysiloxane, said amino groups or epoxy groups being necessary to increase the softness of the fiber after it has been treatd with the composition of this invention.

Examples of organoalkoxysiloxanes which can be used as component (D) are: γ-aminopropyltriethoxysilane, N(β-aminoethyl)-γ-aminopropylmethyldimethoxysilane, N(β-aminoethyl)-γ-aminopropyltrimethoxysilane, N-cyclohexyl-γ-aminopropyltrimethoxysilane, γ-morpholinopropylmethyldimethoxysilane, γ-glycidoxylpropyltrimethoxysilane, and β-(3,4-epoxycyclohexyl) ethylmethyldimethoxysilane.

These organoalkoxysilanes and/or their partial hydrolysis condensates may either be used alone, or two or more of them may be used in admixture. Their blending proportion is 0.1-20 parts by weight, and preferably 0.5-10 parts by weight, with respect to 100 parts by weight of component (A). If it is less than 0.1 parts by weight, crosslinking is insufficient and the strength of the silicone rubber coating declines, while if it is greater than 20 parts by weight, the silicone rubber coating becomes hard and the softness of the treated fiber declines.

The curing catalyst which is component (E) of this invention is included to cure the components of the treatment agent of this invention. Specific examples are metal salts of organic acids such as dibutyl tin dilaurate, dioctyl tin dilaurate, dibutyl tin diacetate, stannous octate, iron (II) octate, zinc octate and amine compounds such as n-hexylamine and guanidine. Unless these curing catalysts are soluble in water, it is preferable to prepare an emulsified dispersion of them in water using a cationic or non-ionic surfactant.

The blending proportion of component (E) is 0.01-10 parts by weight, and preferably 0.1-5 parts by weight, with respect to 100 parts by weight of component (A). If it is less than 0.01 parts by weight, the treatment agent of this composition does not cure sufficiently and it therefore has inadequate anti-shrink properties. If it is greater than 10 parts by weight, the catalyst which remains in the silicone rubber coating as a non-volatile component adversely affects the properties of the coating.

The composition of this invention may be made up by first preparing a cationic or non-ionic emulsion or aqueous solution of each component, and blending the active ingredients together in the required proportions. However, as the component (C), which is a reaction products of the aminoalkoxysilane and the acid anhydride, normally takes place in alcohol solution, it is not desirable to add it directly to the emulsion of component (A) since it would break up the emulsion. Component (C) must therefore first be blended with an emulsion of component (B), i.e. silica and/or polysilsesquioxane, in which case it is possible to prepare a uniform mixture without breaking up the emulsion. This mixture is then added to component (A) so as to obtain a uniform blend of components (A), (B) and (C).

Components (D) and (E) which are water-soluble are added without modification. Compounds that are not water-soluble are prepared as emulsions, and the added successively to uniform mixed emulsion of components (A), (B) and (C).

In addition to the components of the composition of the above invention which are usually used to treat fibers, other components may also be added in suitable blending proportions such as anti-septics, anti-static agents, penetrants, flame retardants and water repellents.

To obtain excellent anti-shrink properties and softness together with durability to washing, it is preferable that the solids in the treatment agent of this invention which is made to adhere to the fibers represent 0.5–10 parts by weight with respect to the weight of fibers. The composition which is made to adhere to the fibers in this way must be dried and cured. In the case of the fiber treatment agent of this invention, water is allowed to evaporate, and curing then takes place gradually at room temperature. To speed up processing, however, it is preferable to dry the composition at 90°–100° C. for 2–5 minutes, and then heat it at 40°–160° C. for 2–5 minutes to accelerate curing.

When dry, the fiber treatment agent of this invention forms a coating having the excellent properties of silicone rubber. It may therefore be used as a resilience improver, water repellent and waterproofing agent, and confers anti-shrink, anti-crease and anti-pilling properties on fibers. In addition, apart from its use with fibers, it may also be used as a waterproofing agent for construction, and as a release agent for casting purposes.

As described in detail above, after drying, the treatment agent of this invention forms a pliant, tough silicone rubber coating with excellent adhesion to the substrate. If keratinous fibers are treated with the agent of this invention, therefore, it prevents shrinking, confers softness together with durability, and prevents pills forming due to tangling of fibers when garments are worn (anti-pilling effect). In addition to keratinous fibers, moreover, it confers excellent anti-crease properties on other fibers such as cotton, rayon, polyester and nylon.

EXAMPLES

We shall now describe this invention in more detail with reference to specific examples, but it should be understood that this invention is in no way limited to these examples.

EXAMPLES 1–4, AND COMPARATIVE EXAMPLES 1–5

Preparation of Component (A)

1. Preparation of Emulsion A-I 1,000 g of octamethylcyclotetrasiloxane and 5 g of phenyltrimethoxysilane were introduced into a 2 l glass flask equipped with stirrer, thermometer and reflux condenser. After removing water at 120° C. for 2 hours in a current of nitrogen gas, 0.1 g of potassium hydroxide (KOH) was added, and the reaction carried out at 150° C. for 5 hours. The flask was cooled to 100° C., and the contents neutralized with 0.4 g of ethylene chlorohydrin to obtain a dimethylpolysioxane with 3 methoxy groups bonded to silicon atoms.

300 g of the siloxane obtained and 50 g of the surfactant polyoxyethylene nonylphenyl ether were dispersed in 650 g water by a Homomixer to form an Emulsion A-I.

2. Preparation of Emulsion A-II 350 g of octamethylcyclotetrasiloxane, 5 g of the hydrolysis product of N(β-aminoethyl)-γ-aminopropylmethyldimethoxysilane and 5 g of methyltriethoxysilane were dispersed together with 40 g of the surfactant lauryl trimethylammonium chloride in 600 g water by a Homomixer to form an emulsion, and transferred to a 2 l glass flask equipped with thermometer and stirrer. 20 g of a 5 wt % aqueous solution of KOH was then added, and after carrying out an emulsion polymerization at 80° C. for 48 hours, the reaction mixture was cooled to 30° C. and neutralized with 3 g of acetic acid. A cationic emulsion of a dimethyl polysiloxane containing 3 or more OH groups bonded to silicon atoms and aminoalkyl groups (Emulsion A-II) was thus obtained. This emulsion contained 35.2% of non-volatile matter.

Preparation of Component (B)

1. Preparation of Emulsion B-I 150 g of fumed silica of specific surface 300 m/g and 50 g of polyoxyethylene nonylphenyl ether were dispersed in 800 g water by a Homomixer to form an Emulsion B-I.

2. Preparation of Emulsion B-II 300 g of methyl trimethoxysilane and 50 g of lauryl trimethylammonium chloride were dispersed in 600 g water by a Homomixer to form an emulsion, and transferred to a glass flask equipped with thermometer and stirrer. 50 g of a 2 wt % aqueous solution of KOH was added, a hydrolysis condensation reaction carried out at 50° C. for 3 hours, the reaction mixture cooled to 30° C., and then neutralized with 1.0 g of acetic acid to obtain a cationic emulsion of a polymethylsilsesquioxane (Emulsion B-II).

This emulsion contained 19.7% of non-volatile matter.

Preparation of Component (C)

98 g of maleic anhydride and 319 g of ethanol were introduced into a 1 l glass flask equipped with thermometer, reflux condenser, stirrer and dropping funnel, and mixed to give a homogeneous solution. 221 g of γ-aminopropyltriethoxysilane was added from the dropping funnel over a period of 1 hour with stirring at room temperature, and after the addition was complete, stirring was continued for 1 hour to carry out the reaction. The reaction product (Component C) was a light yellow transparent liquid with 48.5% of non-volatile matter.

Preparation of Component (E)

300 g of dioctyl tin dilaurate and 50 g of polyoxyethylene nonylphenyl ether were dispersed in 650 g water by a Homomixer to give an Emulsion E.

Preparation of Fiber Treatment Agent

Component C was added to Emulsion B-I or Emulsion B-II followed by γ-glycidoxypropyl trimethoxysilane or N(β-aminoethyl)-γ-aminopropyl trimethoxysilane (component D) in the blending proportions shown in Table 1 with stirring, and stirring was continued for 15 minutes to obtain a dispersion. This dispersion was added gradually to Emulsion A-I or A-II with stirring, and Emulsion E was then added to obtain various treatment agents.

These agents were diluted with water to prepare treatment solutions of specified concentrations, and after immersing a scoured wool fabric in these solutions, the fabric was squeezed out between rollers to remain substantially 100% by weight of the liquid with respect to the weight of fiber. Next, the fabric was dried at 100° C. for 3 minutes and then heated at 150° C. for 3 minutes so as to obtain a cured fabric.

The treated fabric so obtained was then washed 20 times in a domestic electric washing machine according to the method of JIS L-0217 103, and the shrinkage and softness of the fabric up to the 20th wash was evaluated by the following method. The results are shown in Table 1.

TABLE 1

| | | Example | | | | Comparative Example | | | | |
|---|---|---|---|---|---|---|---|---|---|---|
| | | 1 | 2 | 3 | 4 | 1 | 2 | 3 | 4 | 5 |
| Component of treatment Agent | | | | | | | | | | |
| Emulsion A - I (30%*) | | 20.0 | — | — | — | — | — | — | — | — |
| Emulsion A - II (30%*) | | — | 20.0 | 20.0 | 10.0 | 20.0 | 20.0 | 20.0 | 20.0 | — |
| Emulsion B - I (15%*) | | 4.0 | — | 4.0 | 2.0 | — | — | — | — | — |
| Emulsion B - II (15%*) | | — | 4.0 | — | — | — | 4.0 | 4.0 | 4.0 | — |
| Solution C (45%*) | | 0.4 | 0.4 | 0.4 | 0.2 | 0.4 | — | 0.4 | 0.4 | — |
| γ-glycidoxypropyl-trimenthoxysilane | | — | 0.2 | — | — | — | — | — | — | — |
| N (β-aminoethyl) γ-aminopropyl-trimethoxysilane | | 0.2 | — | 0.2 | 0.1 | 0.2 | 0.2 | — | 0.2 | — |
| Emulsion E (30%*) | | 1.0 | 1.0 | 1.0 | 0.5 | 1.0 | 1.0 | 1.0 | — | — |
| Water | | 74.4 | 74.4 | 74.4 | 87.2 | 78.4 | 74.8 | 74.6 | 75.4 | — |
| Shrinking Rote (%) | washing 1 time | 0 | 0 | 0 | 0 | 1.2 | 2.0 | 1.7 | 3.2 | 3.5 |
| | 5 | 0 | 0 | 0 | 0.3 | 2.9 | 4.2 | 2.6 | 4.0 | 4.2 |
| | 10 | 0.5 | 0.2 | 0.3 | 0.8 | 5.5 | 7.8 | 4.3 | 8.1 | 8.3 |
| | 20 | 1.3 | 0.7 | 1.0 | 1.7 | 10.6 | 11.5 | 8.8 | 11.4 | 15.1 |
| Softness | washing 1 time | ◎ | ◎ | ◎ | ◎ | ○ | ○ | ○ | X | X |
| | 5 | ◎ | ◎ | ◎ | ◎ | Δ | X | Δ | X | X |
| | 10 | ○ | ◎ | ◎ | ○ | X | X | X | X | X |
| | 20 | ○ | ○ | ◎ | ○ | X | X | X | X | X |

*Weight % of non-volatile matter

Shrinking 10 cm × 10 cm standard lines (square) were marked to a treated fabric prior to washing. The length of the standard lines were measured in the vertical and horizontal directions each time the fabric was subjected to a specified number of washes. The vertical and horizontal shrinking were then evaluated by the following equation:

$$\text{Shrinking} = \frac{10 - l}{10} \times 100(\%)$$

where l is the vertical or holizontal length (cm) of the standard line after washing.

Softness

Softness to touch was evaluated on the following 4 steps:

◎:Fabric was very soft and flexible

○:Fabric was fairly soft with some flexibility

Δ: Fabric felt rather hard and showed little flexibility

×:Fabric was stiff with no flexibility

The results of Table 1 demonstrate that the fiber treatment agent of this invention confers good anti-shrink properties and softness on fibers.

What is claimed is:

1. A fiber treatment agent comprising:

(A) 100 parts by weight of an organopolysiloxane with no less than two (a) hydroxyl groups, (b) $C_1$–$C_6$-alkoxy groups, or (c) a combination thereof, bonded to Si atoms per molecule;

(B) 0.5–50 parts by weight of silica, a polysilsesquioxane, or a combination thereof;

(C) 0.1–20 parts by weight of an organoalkoxysilane containing amide groups and carboxyl groups, a partial hydrolysis condensate thereof containing amide groups of carboxyl groups, or a combination thereof;

(D) 0.1–20 parts by weight of an organoalkoxysilane containing amino groups or epoxy groups, a partial hydrolysis condensate thereof, or a combination thereof containing amino groups or epoxy groups; and (E) 0.01–10 parts by weight of a curing catalyst, wherein said catalyst is a cationic or non-ionic emulsion and is selected from the group consisting of metal salts of organic acid and amine compounds.

2. The fiber treatment agent of claim 1, wherein the component (A) has no less than 1 aminoalkyl group as an organic group, apart from said hydroxyl and alkoxy groups per molecule, said aminoalkyl group being represented by the subformula $-R^3(NR^1R^5)_nNR^6R^7$ wherein $R^3$ and $R^5$ are each independently a $C_{1-6}$-bivalent hydrocarbon radical, n is 0–4, and $R^4$, $R^6$ and $R^7$ are each independently H or a $C_{1-20}$-monovalent hydrocarbon radical.

3. The fiber treatment agent of claim 1, wherein the component (A) is synthesized by equilibration reaction of cyclic siloxanes with α, ω-hydroxypolysiloxane oligomers or organoalkoxysilanes carried out to equilibrium and used in an emulsion form, either by preparing an emulsified dispersion of it in water, using cationic or non-ionic surfactants.

4. The fiber treatment agent of claim 1, wherein a blending proportion of component (B) is 1–30 parts by weight with respect to 100 parts by weight of component (A).

5. The fiber treatment agent of claim 1, wherein the component (B) is used in an emulsified form by preparing an emulsified dispersion of silica, polysilsesquioxane, or combination thereof, in water using cationic or non-ionic surfactants.

6. The fiber treatment agent of claim 1, wherein the component (B) is used in an emulsion form which is obtained by:

preparing an emulsified dispersion of the organoalkoxysilane represented by the general formula $R^8_zSi(OR^2)_{4-z}$, wherein $R^8$ is a monovalent hydrocarbon group with 1-20 carbon atoms or an organic group wherein the hydrogen atoms bonded to these carbon atoms are partially substituted by epoxy, amino, carboxyl, hydroxyl, cyano and (meth)acryl groups, $R^2$ is a monovalent hydrocarbon group with 1-6 carbon atoms and Z is 0 or 1, using cationic or non-ionic surfactants, adding a catalyst, and performing a hydrolysis condensation reaction.

7. The fiber treatment agent of claim 1, wherein the blending proportion of component (C) is 0.5-10 parts by weight with respect to 100 parts by weight of component (A).

8. The fiber treatment agent of claim 1, wherein the component (C) is a compound prepared by the reaction of aminoalkoxysilane, a partial hydrolysis thereof, or combination thereof, with acid anhydride.

9. The fiber treatment agent of claim 8, wherein said aminoalkoxysilane is a compound represented by the general formula A $R^1_ySi(OR^2)_{3-y}$ wherein $R^1$ is a monovalent hydrocarbon group with 1-6 carbon atoms, A is $—R^3(NR^4R^5)_nNR^6R^7$, $R^3$ and $R^5$ are each independently a bivalent hydrocarbon group with 1-6 carbon atoms, $R^4$, $R^6$ and $R^7$ are each independently a hydrogen atom or a monovalent hydrocarbon group with 1-20 carbon atoms, n is an integer from 0-4, and y is 0, 1 or 2 and said acid anhydride is selected from the group consisting of phthalic anhydride, succinic anhydride, methyl succinic anhydride, maleic anhydride, pyromellitic anhydride, trimellitic anhydride, itaconic anhydride, glutanic anhydride, diphenic anhydride and benzophenone tetracarbonic anhydride.

10. The fiber treatment agent of claim 1, wherein the component (D) is at least one compound selected from the group consisting of γ-aminopropyltriethoxysilane, N(β-aminoethyl)-γ-aminopropylmethyldimethoxysilane, N(β-aminoethyl)-γ-aminopropyltrimethoxyselane, N-cyclohexyl-γ-aminopropyltrimethoxysilane, γ-morpholinopropylmethyldimethoxysilane, γ-glycidoxytrimethoxysilane, and β-(3,4-epoxycyclohexyl) ethylmethyldimethoxysilane.

11. The fiber treatment agent of claim 1, wherein a blending proportion of component (D) is 0.5-10 parts by weight with respect to 100 parts by weight of component (A).

12. The fiber treatment agent of claim 1, wherein the component (E) is at least one compound selected from the group consisting of dibutyl tin dilaurate, dioctyl tin dilaurate, dibutyl tin diacetate, stannous octate, iron (II) octate, zinc octate, n-hexylamine and guanidine.

13. The fiber treatment agent of claim 1, wherein component (E) is a non-aqueous curing catalyst which is used in an emulsion form by preparing an emulsified dispersion of it in water, using cationic or non-ionic surfactants.

14. The fiber treatment agent of claim 1, wherein a blending proportion of component (E) is 0.1-5 parts by weight with respect to 100 parts by weight of component (A).

15. The fiber treatment agent of claim 1, wherein said agent is prepared by mixing the component (C) into an emulsion of component (B), the obtained mixture is then added to component (A), and after that component (D) and component (E) are successively mixed into a uniform mixture of component (A), (B) and (C).

16. A fiber obtained by a process comprising making adhere a fiber treatment agent of claim 1 to a fiber surface, then the agent is dried and cured.

17. The fiber of claim 16, wherein a proportion of the agent adhered is 0.5-10% by weight with respect to the weight of the fiber in a solid basis.

18. The fiber of claim 16, wherein the drying process is carried out for 2-5 minutes at 90°-100° C. and the curing process is carried out for 2-5 minutes at 140°-160° C.

* * * * *